US011191395B2

(12) United States Patent
Shaukat et al.

(10) Patent No.: US 11,191,395 B2
(45) Date of Patent: Dec. 7, 2021

(54) WEARABLE FLUID-DISPENSING APPARATUS

(71) Applicant: INTEL Wrist, LLC, Miami, FL (US)

(72) Inventors: Kashif Shaukat, Davie, FL (US); Bernard Lagroue, Miramar, FL (US)

(73) Assignee: INTEL WRIST, LLC, Miami, FL (US)

( * ) Notice: Subject to any disclaimer, the term of this patent is extended or adjusted under 35 U.S.C. 154(b) by 0 days.

(21) Appl. No.: 16/872,305

(22) Filed: May 11, 2020

(65) Prior Publication Data

US 2020/0268217 A1 Aug. 27, 2020

Related U.S. Application Data

(63) Continuation of application No. 15/886,815, filed on Feb. 1, 2018, now Pat. No. 10,646,076, which is a (Continued)

(51) Int. Cl.
*A47K 5/12* (2006.01)
*B05B 11/00* (2006.01)
(Continued)

(52) U.S. Cl.
CPC ..... *A47K 5/1201* (2013.01); *A44C 5/0007* (2013.01); *A44C 5/14* (2013.01);
(Continued)

(58) Field of Classification Search
CPC ..... A44C 5/0007; A44C 5/14; A44C 5/20; B05B 9/085; B05B 11/3014;
(Continued)

(56) References Cited

U.S. PATENT DOCUMENTS 5,924,601 A * 7/1999 Chen ..... F41H 9/10 222/175
5,927,548 A * 7/1999 Villaveces ..... A45F 5/02 222/175

(Continued)

*Primary Examiner* — Vishal Pancholi
*Assistant Examiner* — Bob Zadeh
(74) *Attorney, Agent, or Firm* — Kilpatrick Townsend & Stockton LLP

(57) ABSTRACT

A wearable fluid-dispensing apparatus that includes a flexible wristband coupled to and surrounding a wrist-arm area of a user, with the wristband having a frame disposed along an outer surface of the wearable wristband and at a ventral side of the user's wrist, an enclosed cartridge coupled to the frame for housing a fluid therein, and a fluid transfer conduit disposed within the enclosed cartridge for transporting the fluid from the enclosed cartridge to a nozzle port on a finger-activatable pump assembly coupled to the frame. The pump assembly defines a nozzle port disposed above a top end of the wristband and angled toward the user's palm, defining a fluid extraction passageway fluidly coupled to the nozzle port and the fluid transfer conduit, and operably configured to translate downwardly toward the fluid extraction passageway fluidly to generate a vacuum therein and emit the fluid on the user's inner hand.

20 Claims, 9 Drawing Sheets

Related U.S. Application Data continuation of application No. 15/169,916, filed on Jun. 1, 2016, now Pat. No. 9,888,816.

(60) Provisional application No. 62/189,887, filed on Jul. 8, 2015.

(51) Int. Cl.

| | |
|---|---|
| ***B05B 9/08*** | (2006.01) |
| ***A44C 5/00*** | (2006.01) |
| ***A44C 5/14*** | (2006.01) |
| ***A44C 5/20*** | (2006.01) |
| ***B05B 15/62*** | (2018.01) |

(52) U.S. Cl.

CPC ..... *A44C 5/20* (2013.01); *A47K 5/1204* (2013.01); *A47K 5/1211* (2013.01); *B05B 9/085* (2013.01); *B05B 11/0038* (2018.08); *B05B 11/0054* (2013.01); *B05B 11/3014* (2013.01); *B05B 15/62* (2018.02); *A47K 5/1202* (2013.01); *A47K 5/1205* (2013.01); *A47K 5/1207* (2013.01)

(58) Field of Classification Search

CPC . B05B 11/0038; B05B 11/0054; B05B 15/62; A47K 5/1201–1202; A47K 5/1204–1205; A47K 5/1207; A47K 5/1211; C12N 9/1074; C12P 19/18; C12P 19/44

USPC ..... 239/154, 329; 222/175, 180, 325–327, 222/153.01–153.14, 321.7–321.9, 209, 222/82–83, 131, 385

See application file for complete search history.

(56) References Cited

U.S. PATENT DOCUMENTS

| | | | | |
|---|---|---|---|---|
| 6,883,563 | B2 * | 4/2005 | Smith | A47K 5/1202 141/102 |
| 6,983,864 | B1 * | 1/2006 | Cagle | B05B 11/0005 222/131 |
| 7,316,332 | B2 * | 1/2008 | Powers | A45D 34/00 222/1 |
| 7,637,394 | B2 * | 12/2009 | Grant | A44B 15/005 222/182 |
| 8,857,668 | B2 * | 10/2014 | Auerbach | B05B 11/3091 222/153.13 |
| 8,973,788 | B1 * | 3/2015 | Burns | A47K 5/1201 222/175 |
| 9,888,816 | B1 * | 2/2018 | Shaukat | A47K 5/1204 |
| 9,943,159 | B1 * | 4/2018 | Novikova | B65D 43/26 |
| 10,646,076 | B2 * | 5/2020 | Shaukat | B05B 9/085 |
| 2004/0111071 | A1 * | 6/2004 | Powers | A45D 34/00 604/310 |
| 2006/0289567 | A1 * | 12/2006 | Shoham | A61B 90/80 222/175 |
| 2007/0164050 | A1 * | 7/2007 | Knight | A45F 5/02 222/175 |
| 2008/0251539 | A1 * | 10/2008 | Yapaola | A47K 5/1202 222/175 |
| 2011/0155765 | A1 * | 6/2011 | Properzi | A47K 5/1201 222/175 |
| 2012/0218106 | A1 * | 8/2012 | Zaima | H04W 4/027 340/540 |
| 2017/0122708 | A1 * | 5/2017 | Gorinas | F41H 9/10 |
| 2017/0156454 | A1 * | 6/2017 | Abadi | A47K 5/1204 |
| 2020/0023391 | A1 * | 1/2020 | Cesare | B65D 47/0809 |
| 2020/0245822 | A1 * | 8/2020 | Chacon, Jr. | A44C 5/0007 |
| 2020/0268217 | A1 * | 8/2020 | Shaukat | A47K 5/1211 |

* cited by examiner

WEARABLE FLUID-DISPENSING APPARATUS

CROSS-REFERENCE TO RELATED APPLICATION

This application is a continuation application of pending U.S. patent application Ser. No. 15/886,815, filed Feb. 1, 2018, now U.S. Pat. No. 10,646,076, which is a continuation application of pending U.S. patent application Ser. No. 15/169,916, filed Jun. 1, 2016, which claims priority to U.S. Provisional Patent Application No. 62/189,887, filed Jul. 8, 2015, the entirety of both are incorporated by reference.

FIELD OF THE INVENTION

The present invention relates to application of a fluid, such as an antibacterial composition, to an individual's hands and, more particularly, is concerned with a wearable fluid-dispensing apparatus for dispensing, among other things, an antibacterial fluid composition.

BACKGROUND OF THE INVENTION

Concerns about personal hygiene have become increasingly prevalent in modern society. With seemingly ever-increasing frequency we hear of spreading viruses, threats of epidemics, and a general heightened awareness of the multitude of germs that we come in contact with every day. For most people, good hygiene is so much an integral part of their daily routine that they think little about it. Among other hygienic practices, for example, individuals wash their hands before and after preparing and/or eating food, and after handling an object or coming into contact with a potentially unsanitary surface. Various products are available to help sanitize an individual's hands, such as wipes infused with a liquid antibacterial solution, antibacterial soaps, and the like.

Consequently, the population as a whole has become ever more conscious of the danger posed by pathogens such as *E. coli*, Ebola, the growing threat of the bird flu virus and other viruses, as well as the more common pathogens an individual comes into contact with on a daily basis. The constant exposure to a wide variety of bacteria and viruses, particularly through contact with unsanitary surfaces, has the potential to cause any one of a number of undesirable infections. The acquisition and transfer of bacteria via a person's hands is recognized as a major factor in the spread of disease. Thus, antibacterial products for hand washing are formulated to reduce the number of bacteria on a person's hands more effectively than plain soap. In response to this threat, many businesses offer their patrons access to antibacterial products. For instance, supermarkets commonly offer antibacterial wipes for consumers to use to wipe the handle of a shopping cart, as well as antibacterial dispensers in areas dedicated for bottle returns and the like.

However, not every business encountered by consumers offer access to complementary antibacterial products. Further, individuals frequently experience unsanitary situations throughout the day where it is impractical to immediately wash one's hands with soap and water, or to carry a commercially available container of antibacterial solution or a dispenser of antibacterial wipes. Therefore, as an insight by the inventor herein, it would be highly desirable to provide a fashionable wearable device having a means for storing, and quickly and efficiently dispensing, a quantity of antibacterial solution onto the hands of a wearer of the device. Furthermore, as another insight by the inventor herein, it would be desirable to provide such an apparatus wherein a volume of such a solution or composition could be provided within a disposable cartridge adapted to be releasably engaged with a dispensing mechanism integrated into the device Therefore, a need exists to overcome the problems with the prior art as discussed above.

SUMMARY OF THE INVENTION

The invention provides a wearable fluid-dispensing apparatus that overcomes the hereinafore-mentioned disadvantages of the heretofore-known devices and methods of this general type and that is operably configured to effectively and efficiently sanitize a user's hands.

With the foregoing and other objects in view, there is provided, in accordance with the invention, a wearable fluid-dispensing apparatus having a flexible wristband configured to define a circular opening and couple to and surround a wrist-arm area of a user disposed within the circular opening and a frame disposed along an outer surface of the wearable wristband and configured for placement at a ventral side of the user's wrist, the frame having a bottom wall, an upper wall, a pair of integral clasps, and a pair of lateral walls defining a receptacle. The apparatus may also include an enclosed cartridge selectively removably coupled and retained to the frame with the integral clasps and disposed within the receptacle, the enclosed cartridge for housing a fluid therein and having an extraction port disposed on an upper end of the enclosed cartridge and a fluid transfer conduit disposed within the enclosed cartridge and having a lower end disposed proximal to an inner surface of a lower end of the enclosed cartridge and an upper end coupled to an inside surface of the enclosed cartridge and disposed proximal to the extraction port of the enclosed cartridge. Additionally, a pump assembly may be coupled to the frame and including a piston that is operably configured to have a static position and a depressed position along a piston translation path spanning towards and away from the bottom wall of the frame and defining an axis of movement of the depression of the piston. The piston may also define a nozzle port angled in an orientation facing away from the top end of the wristband and a fluid extraction passageway operably configured to be fluidly coupled to the nozzle port and the fluid transfer conduit. The piston is also operably configured to translate along the piston translation path to pressurize a fluid disposed within the fluid extraction passageway through the nozzle port in a fluid emission path at an acute emission angle with respect to the axis of movement of the depression of the piston and directed away from the top end of the wristband.

In accordance with an additional feature of the present invention, the nozzle port is disposed above a top end of the wristband and the emission angle is approximately 45° with respect to the axis of movement of the depression of the piston.

In accordance with another feature, an embodiment of the present invention includes the pump assembly being finger-activatable and with the piston having a top portion defining a terminal upper end of the piston and a lever coupled thereto and extending downwardly from the terminal upper end of the piston to interpose, with the frame, a portion of the enclosed cartridge.

In accordance with an additional feature of the present invention, the lever including an outer surface of an arcuate shape and terminating at a distal end of the lever.

In accordance with yet another feature, an embodiment of the present invention also includes the outer surface of the lever having at least one protrusion disposed thereon for tactile feedback to the user.

In accordance with yet another feature, an embodiment of the present invention also includes the finger-activatable pump assembly having a housing defining a lower port, the housing coupled to the enclosed cartridge in a watertight configuration with the lower port of the housing fluidly coupled to the extraction port of the enclosed cartridge.

In accordance with an exemplary feature, an embodiment of the present invention also includes the enclosed cartridge having two opposing sidewalls, a rear wall, and a bottom wall, wherein the receptacle is shaped and sized to conform to a shape of the enclosed cartridge defined by a portion of the rear wall and the two opposing sidewalls of the enclosed cartridge.

In accordance with a further feature, an embodiment of the present invention also includes a plurality of fixed risers interposing the piston and having a terminal end disposed above a top portion defining a terminal upper end of the piston.

Also in accordance with the present invention, a wearable fluid-dispensing apparatus is disclosed that includes a flexible wristband configured to define a circular opening and couple to and surround a wrist-arm area of a user disposed within the circular opening and a frame disposed along an outer surface of the wearable wristband and configured for placement at a ventral side of the user's wrist, wherein the frame has a bottom wall, an upper wall, and a pair of lateral walls defining a receptacle. The apparatus includes an enclosed cartridge coupled to the frame and disposed within the receptacle, the enclosed cartridge for housing a fluid therein and having an extraction port disposed on an upper end of the enclosed cartridge. The apparatus includes a fluid transfer conduit disposed within the enclosed cartridge and having a lower end disposed proximal to an inner surface of a lower end of the enclosed cartridge and an upper end disposed proximal to the extraction port of the enclosed cartridge. A pump assembly is also coupled to the frame and includes a piston operably configured to have a static position and a depressed position along a piston translation path spanning towards and away from the bottom wall of the frame and defining an axis of movement of the depression of the piston. The piston defines a nozzle port angled in an orientation facing away from the top end of the wristband and the circular opening defined by the flexible wristband and a fluid extraction passageway operably configured to be fluidly coupled to the nozzle port and the fluid transfer conduit. The piston is also operably configured to translate along the piston translation path to pressurize a fluid disposed within the fluid extraction passageway through the nozzle port in a fluid emission path at an acute emission angle with respect to the axis of movement of the depression of the piston and directed away from the top end of the wristband.

In accordance with a further feature of the present invention, the piston is operably configured to translate upwardly away from the fluid extraction passageway to emit the fluid housed in the enclosed cartridge from the nozzle port in a fluid emission path at an emission angle directed toward the user's palm. The emission angle may also be approximately 45° with respect to the upward direction of translation of the piston.

Although the invention is illustrated and described herein as embodied in a wearable fluid-dispensing apparatus, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to a direction of the depressing of the piston of the pump assembly.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
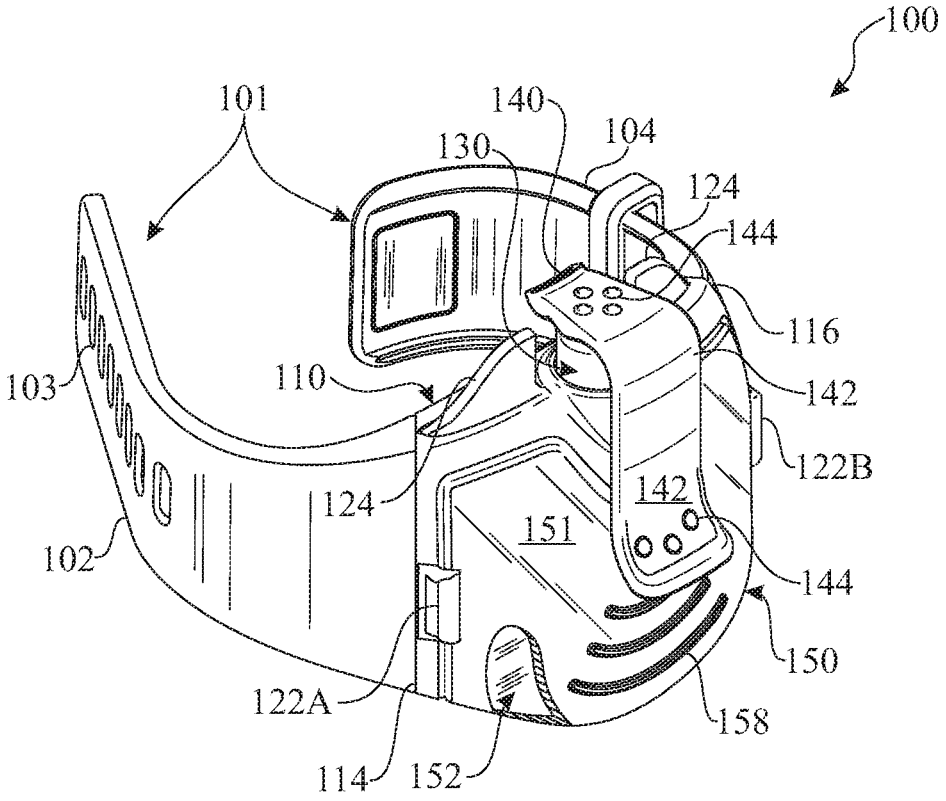
FIG. 1 is an upper front isometric view of an exemplary embodiment of a wearable fluid-dispensing apparatus in the form of an antibacterial fluid-dispensing bracelet in accordance with aspects of the present invention.
Figure 2:
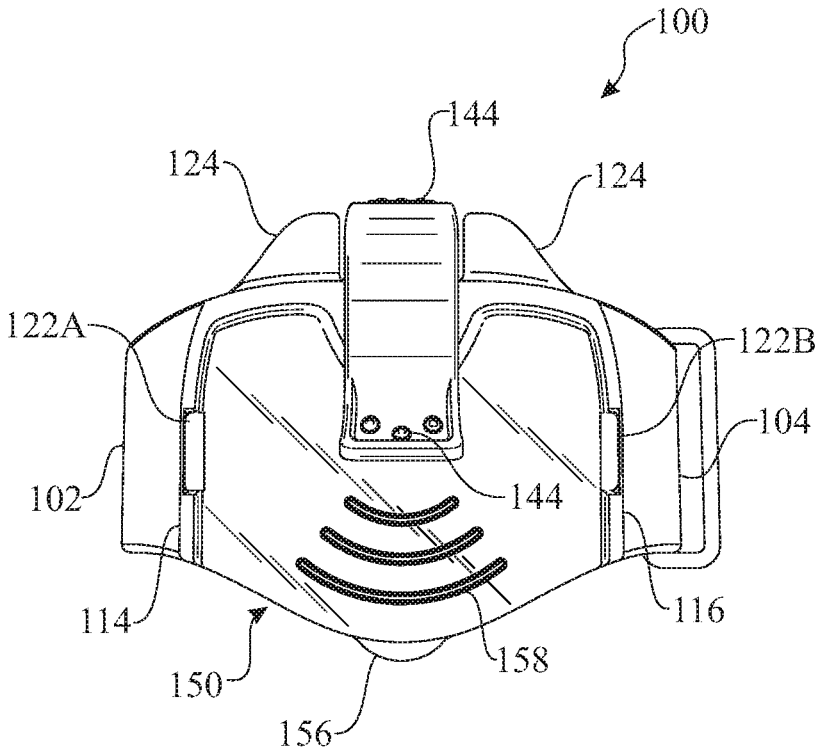
FIG. 2 is a front elevation view of the antibacterial fluid-dispensing bracelet originally introduced in FIG. 1.
Figure 3:
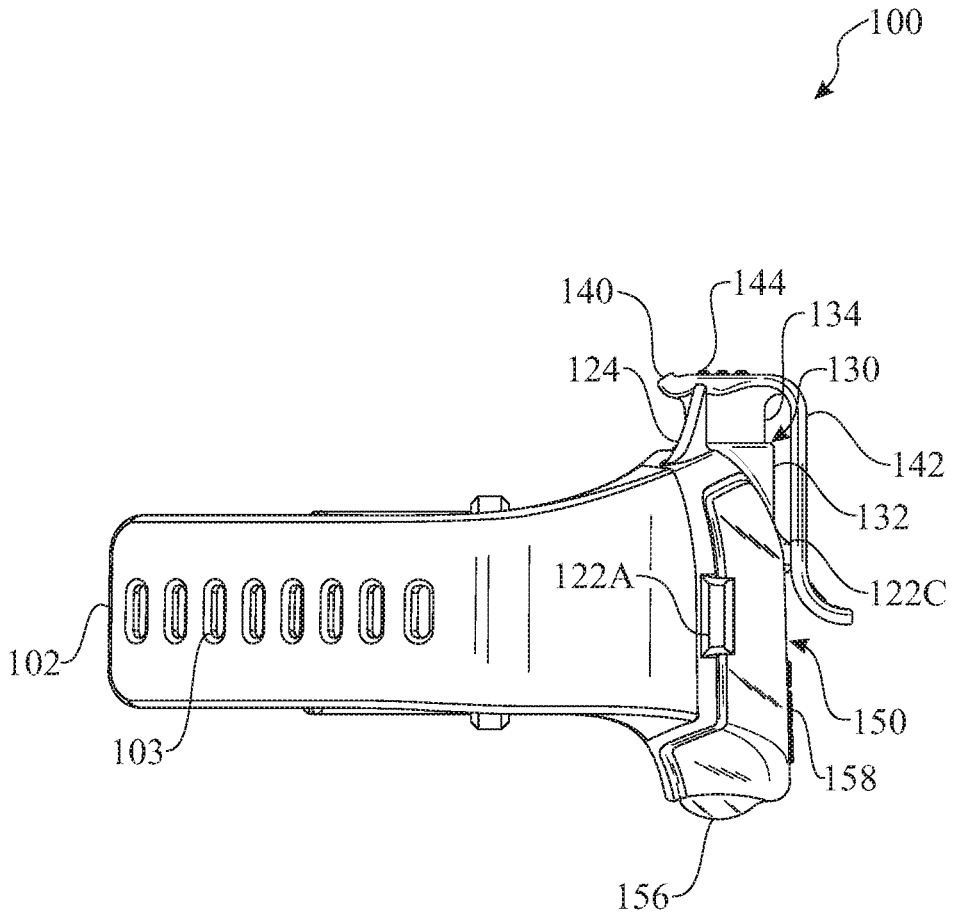
FIG. 3 is a side elevation view of the antibacterial fluid-dispensing bracelet originally introduced in FIG. 1 and as seen from left of the bracelet in FIG. 2.
Figure 4:
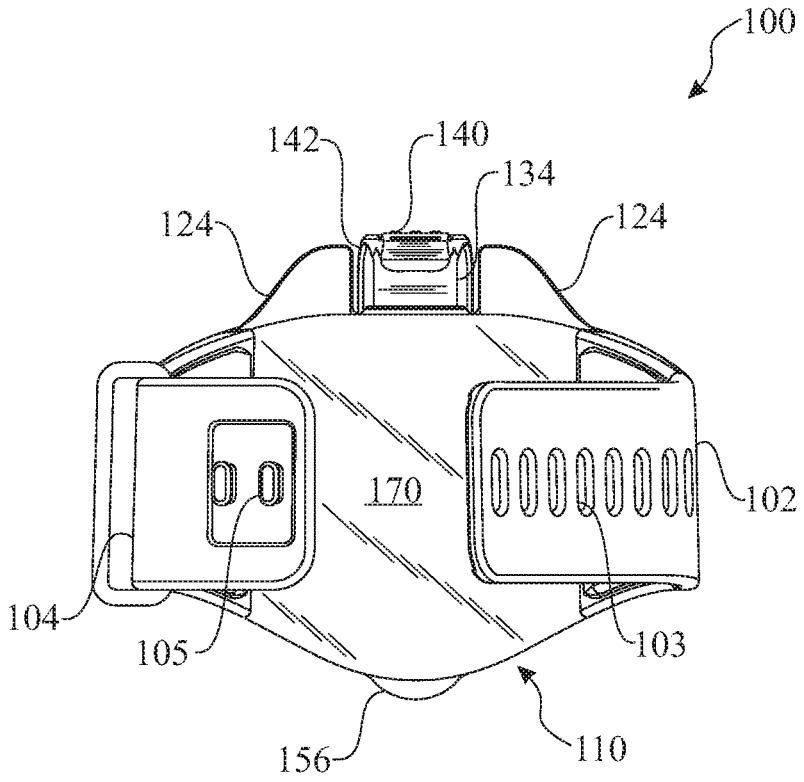
FIG. 4 is a rear elevation view of the antibacterial fluid-dispensing bracelet originally introduced in FIG. 1.
Figure 5:
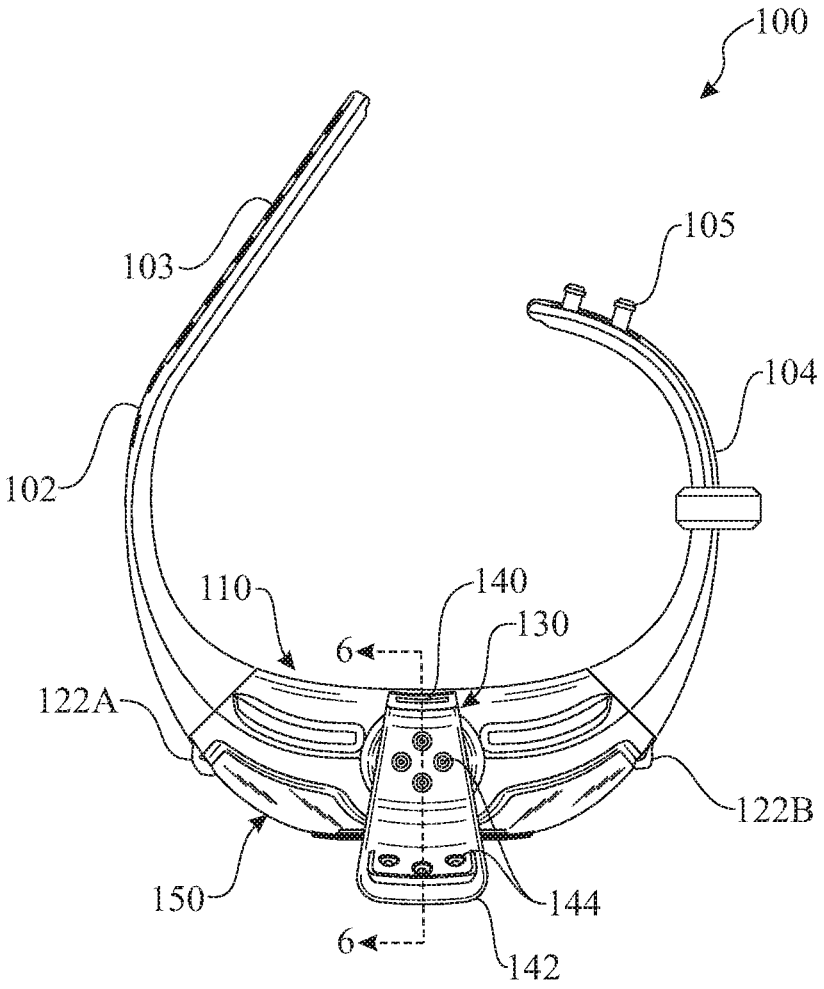
FIG. 5 is a top plan view of the antibacterial fluid-dispensing bracelet originally introduced in FIG. 1.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient wearable fluid sanitizing dispenser. Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left," "rear," "right," "front," "vertical," "horizontal," and derivatives thereof relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Referring now to accompanying FIGS. 1-9, an exemplary implementation embodying aspects of the present invention is depicted. Specifically, a wearable fluid dispensing apparatus, generally designated as 100, in the form of a fluid-dispensing bracelet, preferably wearable about the wrist/forearm of an individual. The bracelet 100 generally includes a frame 110, and a finger-activatable pump assembly 130 supported, and an arcuate-shaped receptacle 120 (FIGS. 7 and 8) defined, by the frame 110. The frame 110 has a slightly curved bottom wall 115 and a pair opposite first and second lateral side walls, 114 and 116 flared outwardly in opposite directions from a pair of opposite side edges of the bottom wall 115, respectively, defining the central receptacle 120, which is sized, shaped and otherwise has a geometry to conform with and receive a cartridge 150 containing a fluid, such as of an antibacterial fluid. While the wearable fluid-dispensing bracelet 100 can be used with a cartridge 150 containing any fluid, it is best suited for use with fluids, such as an antibacterial fluid, sunscreen, etc., to be used on the body of the wearer.

The frame 110 also may have a pair of integral clasps, 122A and 122B, extending from the corresponding respective lateral side walls, 114 and 116, for releasable engagement with the antibacterial fluid-containing cartridge 150 to aid in retaining the cartridge within the central receptacle 120 of frame 110. Preferably, the clasps 122A, 122B are integrally molded with lateral side walls 114, 116 of the frame 110 to form a unitary structure, wherein the clasps are resilient vis-à-vis the frame 110 to enable deflection of the clasps for snap-fitting engagement with cartridge 150, in a manner well known in the art. Those practiced in the art will readily recognize that the clasps can also assume other configurations known in the art.

The wearable fluid-dispensing apparatus or bracelet 100 also includes a wearable member 101 formed by a female wristband segment 102 and a male wristband segment 104. The female wristband segment 102 is affixed to the frame 110 proximate the first lateral side wall 114. The female wristband segment 102 has a series of spaced apart apertures 103 along a length thereof to aid in fastening the bracelet 100 to a user's wrist or forearm. In like manner, the male wristband segment 104 is affixed to the frame 110 proximate the second lateral side wall 116. The male wristband segment 104 may include one or more pegs 105, or comparable projections, extending therefrom for releasable engagement with selected ones of the apertures 103 of the female wristband 102 to releasably secure the bracelet 100 to a user's wrist or forearm, in a manner well known in the art. Those practiced in the art will recognize that other known configurations of the wearable member 101 attached to the frame 110 are contemplated herein.

Figure 6B:
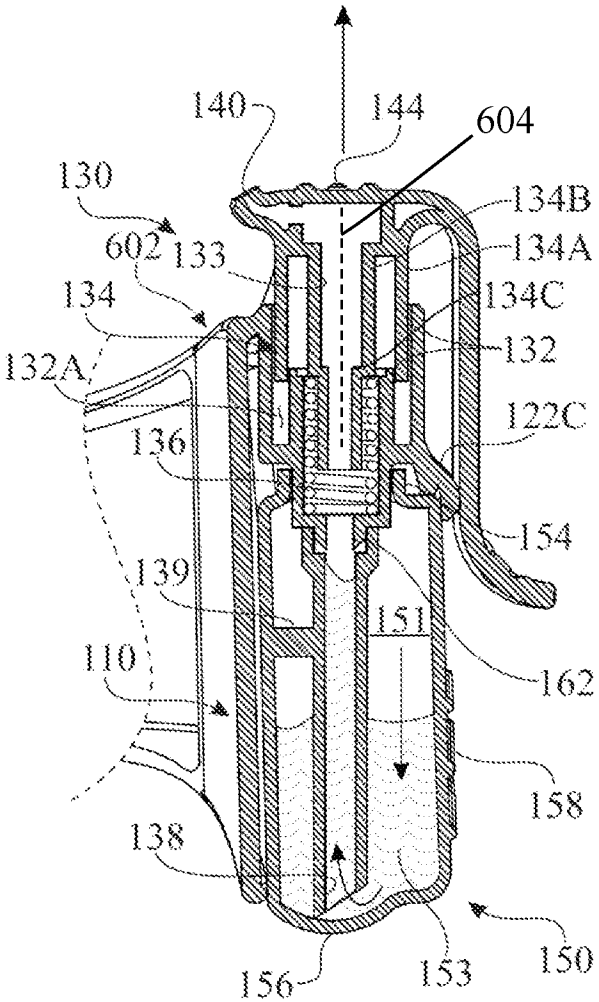
FIG. 6B is a cross-sectional view of the antibacterial fluid-dispensing bracelet originally introduced in FIG. 5, and as taken along section line 6-6 of FIG. 5, wherein the pump assembly of the fluid-dispensing bracelet is shown in an equilibrium (unbiased) state.
Figure 6A:
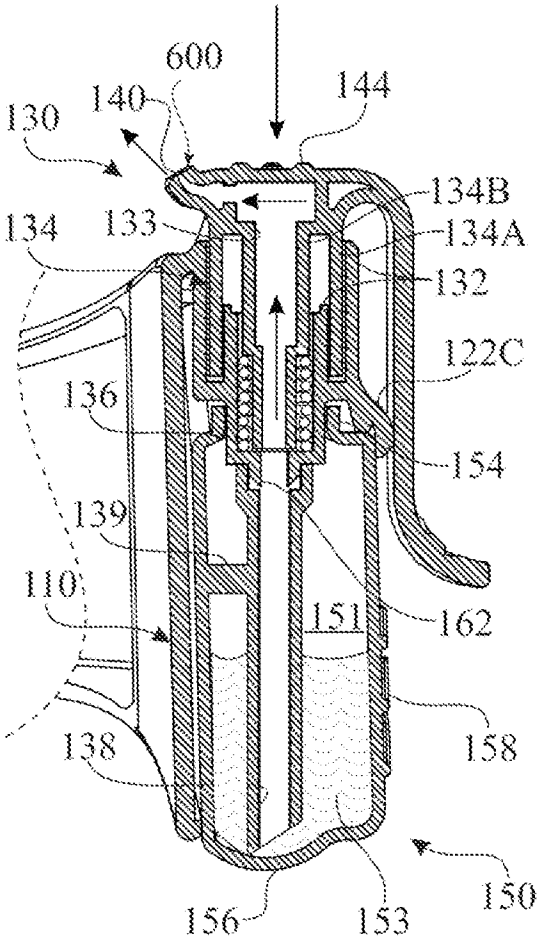
FIG. 6A is a cross-sectional view of the antibacterial fluid-dispensing bracelet originally introduced in FIG. 5, and as taken along section line 6-6 of FIG. 5, wherein a finger-activated pump assembly of the fluid-dispensing bracelet is shown in a downwardly-biased (pressure applied) dispensing state.
Figure 7:
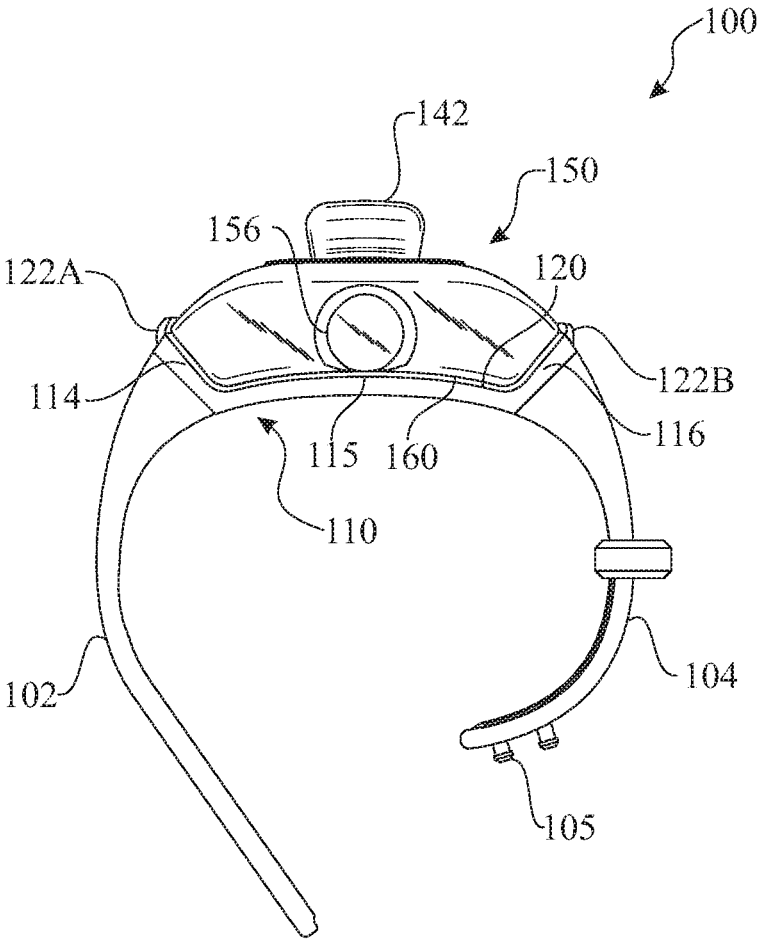
FIG. 7 is a bottom plan view of the antibacterial fluid-dispensing bracelet originally introduced in FIG. 1.
Figure 8:
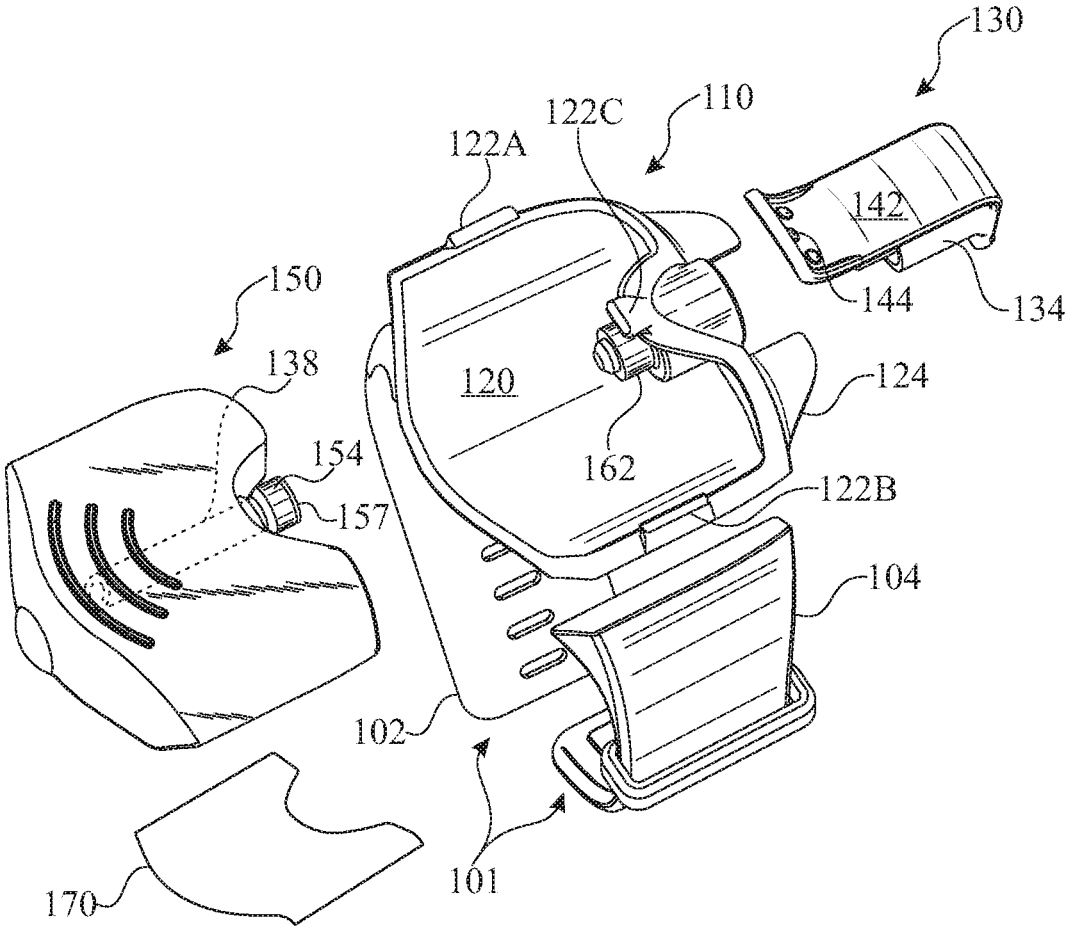
FIG. 8 an exploded isometric view of the antibacterial fluid dispensing bracelet originally introduced in FIG. 1.

Referring now particularly to FIGS. 1, 6A and 6B, fluid-containing cartridge 150 has a body defining an interior reservoir 152 for retaining a volume of antibacterial fluid 153 and is retained within frame 110 by lateral clasps 122A, 122B and a central clasp 122C on an upper wall of frame 110 proximate to the central receptacle 120 and at one end of the bottom wall 115 and opposite first and second lateral sidewalls 114, 116 thereof. A grip area 158 can be included on the front exterior surface 151 of the cartridge 150 to aid in the removal and insertion of the cartridge 150. As best seen in FIG. 8, the cartridge 150 also defines an annular-shaped extraction port 154 at a top center thereof for engagement with an annular housing portion 132 of the finger-activatable pump assembly 130, as described below. A bulge 156 (see also FIGS. 2-4) is formed at a central bottom portion of the cartridge 150 to provide a low point for pooling of the antibacterial fluid when the fluid level is at a minimum, in order to minimize waste of the antibacterial fluid. A rear exterior surface 160 (FIG. 7) of cartridge 150 can also include a label 170 applied thereto wherein the label 170 includes descriptive and usage information related to the fluid retained therein. In this case, it is preferable that the cartridge is constructed of a translucent (clear) material. This also facilitates viewing through the cartridge to determine the relative quantity of fluid remaining. Although not depicted, it will be apparent to those skilled in the art that the cartridge 150 may be constructed having hash marks for determining the remaining volume of fluid 153.

As best illustrated in FIGS. 1, 3, 6A and 6B, the finger-activatable pump assembly 130 at the annular housing 132 thereof is affixed to, or at regions thereof is integrally formed with, the upper wall of the frame 110. The pump assembly 130 thus includes the annular-shaped housing 132, preferably having a double-walled structure, which are two concentrically arranged and aligned sidewalls (as shown in FIGS. 6A and 6B). The pump assembly 130 also includes a piston 134 vertically slidable within and supported by the annular housing 132. The piston 134 includes a pair of spaced apart exterior and interior walled portions 134A and 134B and a bottom walled portion 134C attached to, and offset inwardly and extending downwardly from, the interior walled portion 134B. The exterior walled portion 134A of the piston 134 is slidably retained in an annular slot 132A formed within and defined by the double-walled structure of the annular housing 132. The interior walled portion 134B of the piston seats on a top end of, and the bottom walled piston portion 134C of the piston 134 extends downward through, a centrally-located biasing spring 136 supported in the annular slot (shown best in FIGS. 6A and 6B) of the annular housing 132. The interior and bottom walled portions 134B and 134C of the piston 134 define a centrally-located extraction passageway 133 through the piston 134 and into fluid communication with a fluid transfer conduit 138 (or "dip tube") of the cartridge 150, as described further hereinbelow.

The piston 134 of the pump assembly 130 is translatable between a raised position (FIG. 6B) and a depressed position (FIG. 6A), i.e., it may have a two-stroke pump cycle. The piston 134 defines at an upper portion thereof, protruding beyond the annular housing 132, a nozzle port 140 from which a quantity of fluid, pumped upwardly from the cartridge 150, through the fluid transfer conduit 138 and the extraction passageway 133, is dispensed during activation of the pump assembly 130. An upper end of the biasing spring 136, such as a compression spring, engages the interior walled portion 134B of the piston 134 to bias the piston 134 in the raised position (FIG. 6B). The fluid transfer conduit 138 is fixedly attached to the sidewall of the cartridge 150 via an attachment structure 139 such that the conduit 138 is fixedly retained in a generally vertically disposed orientation with a lower end extending into cartridge bulge 156 and an upper end fitted about a lower portion of the annular housing 132 defining a lower port 162 of the pump assembly 130. The annular housing 132 of the pump assembly 130, above the lower port 162 thereof, snugly fits through the extraction port 154, i.e., the cartridge mouth or cartridge port, of the cartridge 150 such that the piston 134 communicates via the extraction passageway 133 through the interior and bottom walled portions 134B and 134C thereof with the interior reservoir 152 of the cartridge 150. A lower end of the biasing spring 136 is seated on an annular shoulder in the extraction port 154. The fluid transfer conduit 138, the annular housing 132, and the piston 134 define a fluid pathway extending, centrally through the biasing spring 136, between the interior reservoir 152 (FIG. 1) of the antibacterial fluid-containing cartridge 150 and the fluid extraction passageway 133 (or "pump chamber") just shy of the nozzle port 140, wherein the pump chamber can be seen extending from the nozzle port 140, i.e., outlet valve, to the lower port 162, i.e., inlet valve.

The annular housing 132 of the pump assembly 130 closely fits or engages with the extraction port 154 of the antibacterial fluid-containing cartridge 150 when the cartridge 150 is fully engaged with the frame 110 and retained in place by the clasps 122A, 122B and 122C, and provides a leak-proof seal at the extraction port 154. The fluid transfer conduit 138 at its upper end is spaced below the extraction port 154 of the cartridge 150 and extends downward through the interior reservoir 152 of the cartridge 150 substantially to the bottom of the cartridge bulge 156 for maximum extraction of the antibacterial fluid therein. The upper wall of the frame 110 can also include fixed risers 124, or "guards," which are disposed on either side of the upper portion of the piston 134 proximate to the nozzle port 140 thereof to protect the piston 134 of the pump assembly 130 from inadvertent activation or from catching on clothing or other articles.

The piston 134 of the finger-activatable pump assembly 130 can also include a grip surface 144 at a top portion thereof so that the user can get a tactile indication of when the user's finger is properly positioned to activate the pump assembly 130. Additionally, a lever 142 can be affixed to the piston 134 for activation thereof and also includes a grip surface 144, or one or more protrusions 144, at an end thereof for further tactile feedback to the user. As illustrated in FIGS. 6A and 6B, the piston 134 and the lever 142 are integrally molded as a single unit; however other configurations of the piston 134, the nozzle port 140, and the lever 142 are contemplated.

Referring briefly primarily to FIGS. 6A and 6B, during use a user initially activates, by depressing, the piston 134 of the pump assembly 130 as depicted by the downward arrows in FIG. 6A, and then de-activates, by releasing, the piston of the pump assembly, creating a vacuum, or negative pressure, that draws a volume of fluid 153 up through conduit 138 into fluid extraction passageway 133. Subsequently, upon once again activating, by depressing, the piston 134 of the pump assembly 130, pressure forces a volume of the fluid 153 out through nozzle port 140 into the user's hand for subsequent application to the hands and/or other body parts as desired. FIG. 6 depicts the piston 134 in a static position along a piston translation path, or axis of the piston translation path, with the nozzle port 140 disposed above a top end 602 of the wristband. The piston translation path, which can be seen best in FIGS. 6A and 6B, spans in a downward direction toward the fluid extraction passageway 133 and upward in a direction away from the fluid extraction passageway 133.

Figure 9:
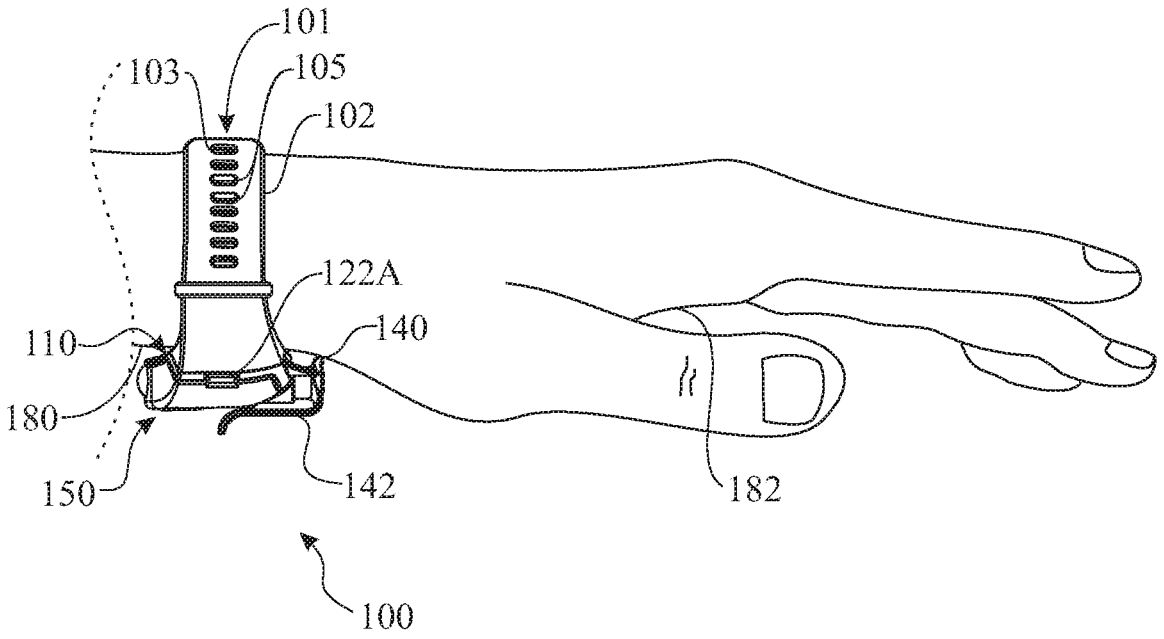
FIG. 9 is a side elevation view of the antibacterial fluid-dispensing bracelet originally introduced in FIG. 1 being shown worn on the wrist of a user.

In use, and as illustrated in FIG. 9, the antibacterial (or other composition of solution) fluid-dispensing bracelet 100 can be worn by a user by placing the frame 110 against an inner portion of the user's wrist 180 and orienting the nozzle port 140 toward the user's inner hand 182. Specifically, also with reference to FIGS. 6A and 6B, the nozzle port 140 may be defined on a substantially planar (referred to herein as "planar") surface 600, wherein the surface 600 and port 140 are configured and oriented to face the palm 182 of a user's hand when the bracelet 100 is worn by the user, i.e., surrounding the wrist-arm area of the user. Said another way, when the bracelet 100 is worn by the user, the frame 110 is disposed on the ventral side of the user's wrist with the nozzle port 140 and fluid emission path (shown best with the arrow depicted in FIG. 6B) from the nozzle port 140 disposed above a top end 602 of the wristband and angled and oriented (hereinafter "emission angle"), approximately 45° (with respect to the downward direction or axis of movement, represented with numeral 604, of the depression of the piston 134 of the pump assembly 130 and/or the general directional flow of fluid through the fluid transfer conduit 138 (as depicted by the upward arrow depicted in FIG. 6B). The wristband 100 can be seen positioned on and surrounding a forearm of the user and defining an aperture or channel sized to receive the user's forearm or limb, with the frame 110, finger-activated pump assembly 130, and enclosed cartridge 150 disposed on the ventral side of the user's forearm/wrist area with the nozzle port angled toward the palm or inner hand 182 of the user.

The wristband strap, formed by the female and male wristband segments 102 and 104, is maneuvered to encircle the user's forearm/wrist 180 (as shown in FIG. 9), wherein one or more pegs 105 of male wristband segment 104 are engaged in apertures 103 of female wristband segment 102 to secure the antibacterial fluid-dispensing bracelet 100 in place upon the user's wrist 180. With the bracelet 100 securely in place, the user may go about daily activities. When the situation arises that the user wishes to dispense a quantity of antibacterial fluid, the user places a finger on the grip 144 of either the piston 134 or the lever 142 and then activates, by depressing, the piston 134. This will force a quantity of the antibacterial fluid through the nozzle port 140 in the direction of the inner hand 182 and/or palm of the user. The nozzle port 140 can be seen in FIG. 9 disposed adjacent to the user's hand proximal to the wrist of the user when the liquid is emitted from the nozzle port 140. As seen in FIG. 9, with reference with FIGS. 6A and 6B, the depressing of the piston 134 of the finger-activatable pump assembly 130, or a "depressed position" along the piston translation path (exemplarily shown with arrows in FIGS. 6A and 6B), generates a vacuum on the upstroke of the piston 134 and within the fluid extraction passageway 133 and the fluid transfer conduit 138 to emit (on the downstroke of the piston 134) the fluid housed in the enclosed cartridge 150 through the nozzle port 140 at an acute emission angle (visually depicted with arrows in FIG. 6B) with respect to the downwardly direction toward the fluid extraction passageway 133. Those of skill in the art will appreciate that a two-stroke pump cycle may include one or more one-way valves disposed between the nozzle port 140 and the that enable fluid emission as shown in FIGS. 6A-6B.

When the quantity of antibacterial fluid has been depleted from the interior reservoir 152 of the antibacterial fluid-containing cartridge 150, the user unfastens the clasps 122 from engagement with the cartridge 150 and placing a thumb or finger on the grip portion 158 of the cartridge 150 slides the cartridge 150 downward to disengage from the pump subassembly 130 and frame 110. A new cartridge 150 may then be installed by positioning and sliding the extraction port 154 of the cartridge 150 over the lower port 162 of the housing portion 132 of the pump assembly 130 to tear through a cartridge-opening sealing membrane 157 (FIG. 8) to thereby initiate fluid communication between the cartridge interior 152 and the finger pump fluid extraction passageway 133, via the conduit 138. Additional quantities of antibacterial, or other composition, fluid can then be extracted by activation of the piston 134 of the pump assembly 130 as previously described.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents. By way of example, although the exemplary implementation of the present invention has been described particularly for in conjunction with antibacterial fluid-dispensing cartridges, it is contemplated that the invention will be employed for use with cartridges containing other fluids including, for example, sunscreen, insect repellent and any other compositions available in a fluid form useful for being carried by a person for convenient dispensing and rubbing onto the skin, hair, etc., of the individual's body (or another individual's body).

What is claimed is:

1. A wearable fluid-dispensing apparatus comprising:

a flexible wristband;

a frame disposed along an outer surface of the flexible wristband, the frame comprising:

a curved bottom wall, a pair of opposing first and second lateral side walls, the first and second lateral side walls flared outwardly in opposite directions from a pair of opposing side edges on the bottom wall, respectively, defining a central receptacle, wherein the central receptacle is shaped to conform with and receive a cartridge, and a retaining member extending from the first and second lateral side walls for releasable engagement with the cartridge;

wherein the cartridge is removably coupled to the frame and disposed within the central receptacle, the cartridge for housing a fluid therein and having an extraction port disposed on an upper end of the cartridge, wherein a rear wall of the cartridge corresponds to the shape of the curved bottom wall of the frame;

a fluid transfer conduit disposed within the cartridge and having a lower end disposed proximal to an inner surface of a lower end of the cartridge and an upper end coupled to an inside surface of the cartridge and disposed proximal to the extraction port of the cartridge; and a pump assembly coupled to the cartridge and engaging the extraction port of the cartridge for selectively extracting the fluid from the cartridge.

2. The wearable fluid-dispensing apparatus according to claim 1, wherein the pump assembly comprises a piston:

operably configured to have a static position and a depressed position along a piston translation path spanning towards and away from the curved bottom wall of the frame and defining an axis of movement of the depression of the piston;

defining a nozzle port angled in an orientation facing away from a top end of the wristband;

defining a fluid extraction passageway operably configured to be fluidly coupled to the nozzle port and the fluid transfer conduit; and operably configured to translate along the piston translation path to pressurize the fluid disposed within the fluid extraction passageway through the nozzle port in a fluid emission path at an acute emission angle with respect to the axis of movement of the depression of the piston and directed away from the top end of the wristband.

3. The wearable fluid-dispensing apparatus according to claim 2, wherein:

the nozzle port is disposed above the top end of the wristband.

4. The wearable fluid-dispensing apparatus according to claim 2, wherein:

the emission angle is directed toward a user's palm.

5. The wearable fluid-dispensing apparatus according to claim 2, wherein the pump assembly is finger-activatable and the piston further comprises:

a top portion defining a terminal upper end of the piston; and a lever coupled thereto and extending downwardly from the terminal upper end of the piston to interpose, with the frame, a portion of the cartridge.

6. The wearable fluid-dispensing apparatus according to claim 5, wherein:

the lever including an outer surface of an arcuate shape and terminating at a distal end of the lever.

7. The wearable fluid-dispensing apparatus according to claim 6, wherein the outer surface of the lever further comprises:

at least one protrusion disposed thereon for tactile feedback to a user.

8. The wearable fluid-dispensing apparatus according to claim 5, wherein the pump assembly further comprises:

a housing defining a lower port, the housing coupled to the cartridge in a watertight configuration with the lower port of the housing fluidly coupled to the extraction port of the cartridge.

9. The wearable fluid-dispensing apparatus according to claim 1, wherein the cartridge further comprises:

two opposing sidewalls, a rear wall, and a bottom wall, wherein the central receptacle is shaped and sized to conform to a shape of the cartridge defined by a portion of the rear wall and the two opposing sidewalls of the cartridge.

10. A wearable fluid-dispensing apparatus comprising:

a frame disposed along an outer surface of a flexible wristband, the frame comprising:

a curved bottom wall, a pair of opposing first and second lateral side walls, the first and second lateral side walls flared outwardly in opposite directions from a pair of opposing side edges on the bottom wall, respectively, defining a receptacle, wherein the receptacle is shaped to conform with and receive an enclosed cartridge, and a retaining member extending from the first and second lateral side walls for releasable engagement with the cartridge;

wherein the cartridge is removably coupled to the frame and disposed within the receptacle, the cartridge for housing a fluid therein and having an extraction port disposed on an upper end of the enclosed cartridge, wherein a rear wall of the cartridge corresponds to the shape of the curved bottom wall of the frame;

a fluid transfer conduit disposed within the enclosed cartridge and having a lower end disposed proximal to an inner surface of a lower end of the enclosed cartridge and an upper end disposed proximal to the extraction port of the enclosed cartridge; and a pump assembly coupled to the cartridge and engaging the extraction port of the cartridge for selectively extracting the fluid from the cartridge.

11. The wearable fluid-dispensing apparatus according to claim 10, wherein:

the pump assembly comprises a nozzle port is disposed above a top end of the frame wristband.

12. The wearable fluid-dispensing apparatus according to claim 11, wherein:

an emission angle is approximately 45° with respect to the axis of movement of the depression of a piston of the pump assembly.

13. The wearable fluid-dispensing apparatus according to claim 12, wherein the pump assembly is finger-activatable and the piston further comprises:

a top portion defining a terminal upper end of the piston; and a lever coupled thereto and extending downwardly from the terminal upper end of the piston to interpose, with the frame, a portion of the enclosed cartridge.

14. The wearable fluid-dispensing apparatus according to claim 10, wherein the retaining member on the first and second lateral side walls further comprises:

an integral clasp operably configured to selectively retain the enclosed cartridge to the frame.

15. The wearable fluid-dispensing apparatus according to claim 10, wherein:

the upper end of the fluid transfer conduit is coupled to an inside surface of the cartridge.

16. The wearable fluid-dispensing apparatus according to claim 10, wherein the frame is configured for placement at a ventral side of a user's wrist.

17. A wearable fluid-dispensing apparatus comprising:

a flexible wristband configured to define a circular opening and couple to and surround a wrist-arm area of a user disposed within the circular opening;

a frame disposed along an outer surface of the flexible wristband and configured for placement at a ventral side of a user's wrist, the frame comprising:

a curved bottom wall, a pair of opposing first and second lateral side walls, the first and second lateral side walls flared outwardly in opposite directions from a pair of opposing side edges on the bottom wall, respectively, defining a receptacle, wherein the receptacle is shaped to conform with and receive an enclosed cartridge, and a retaining member extending from the first and second lateral side walls for releasable engagement with the enclosed cartridge;

wherein the enclosed cartridge selectively removably coupled and retained to the frame with the retaining member on the first and second lateral side walls and disposed within the receptacle, the enclosed cartridge for housing a fluid therein and having an extraction port disposed on an upper end of the enclosed cartridge, wherein a rear wall of the cartridge corresponds to the shape of the curved bottom wall of the frame;

a fluid transfer conduit disposed within the enclosed cartridge and having a lower end disposed proximal to an inner surface of a lower end of the enclosed cartridge and an upper end coupled to an inside surface of the enclosed cartridge and disposed proximal to the extraction port of the enclosed cartridge; and a pump assembly coupled to the cartridge and including a piston:

operably configured to have a static position and a depressed position along a piston translation path spanning towards and away from the bottom wall of the frame and defining an axis of movement of the depression of the piston;

defining a nozzle port angled in an orientation facing away from a top end of the wristband;

defining a fluid extraction passageway operably configured to be fluidly coupled to the nozzle port and the fluid transfer conduit; and operably configured to translate along the piston translation path to pressurize the fluid disposed within the fluid extraction passageway through the nozzle port in a fluid emission path at an acute emission angle with respect to the axis of movement of the depression of the piston and directed away from the top end of the wristband.

18. The wearable fluid-dispensing apparatus according to claim 17, wherein:

the nozzle port is disposed above the top end of the wristband; and the emission angle is approximately 45° with respect to the axis of movement of the depression of the piston.

19. The wearable fluid-dispensing apparatus according to claim 17, wherein the pump assembly is finger-activatable and the piston further comprises:

a top portion defining a terminal upper end of the piston; and a lever coupled thereto and extending downwardly from the terminal upper end of the piston to interpose, with the frame, a portion of the enclosed cartridge, the lever including an outer surface of an arcuate shape and terminating at a distal end of the lever.

20. The wearable fluid-dispensing apparatus according to claim 19, wherein the pump assembly further comprises a housing defining a lower port, the housing coupled to the enclosed cartridge in a watertight configuration with the lower port of the housing fluidly coupled to the extraction port of the enclosed cartridge, wherein the enclosed cartridge further comprises two opposing sidewalls, a rear wall, and a bottom wall, wherein the receptacle is shaped and sized to conform to a shape of the enclosed cartridge defined by a portion of the rear wall and the two opposing sidewalls of the enclosed cartridge.

* * * * *